US007661608B2

(12) United States Patent
Grether

(10) Patent No.: US 7,661,608 B2
(45) **Date of Patent: *Feb. 16, 2010**

(54) JET REGULATOR

(75) Inventor: Hermann Grether, Müllheim (DE)

(73) Assignee: Neoperl GmbH, Mullheim (DE)

( * ) Notice: Subject to any disclaimer, the term of this patent is extended or adjusted under 35 U.S.C. 154(b) by 609 days.

This patent is subject to a terminal disclaimer.

(21) Appl. No.: 10/523,574

(22) PCT Filed: Sep. 26, 2003

(86) PCT No.: PCT/EP03/10726

§ 371 (c)(1),
(2), (4) Date: Jan. 28, 2005

(87) PCT Pub. No.: WO2004/033807

PCT Pub. Date: Apr. 22, 2004

(65) Prior Publication Data

US 2006/0102750 A1 May 18, 2006

(30) Foreign Application Priority Data

Oct. 4, 2002 (DE) ..... 102 46 333

(51) Int. Cl.

| | |
|---|---|
| ***E03C 1/08*** | (2006.01) |
| ***B05B 1/26*** | (2006.01) |
| ***B05B 1/14*** | (2006.01) |
| ***B05B 1/00*** | (2006.01) |

(52) U.S. Cl. ..... 239/500; 239/391; 239/396; 239/428.5; 239/462; 239/504; 239/518; 239/553.3; 239/590; 239/590.3; 239/600

(58) Field of Classification Search ..... 239/390, 239/391, 396, 427, 428.5, 462, 500, 504, 239/518, 520, 553, 553.3, 553.5, 590, 590.3, 239/590.5, 600

See application file for complete search history.

(56) References Cited

U.S. PATENT DOCUMENTS

| | | | | |
|---|---|---|---|---|
| 3,105,641 A | | 10/1963 | Curcio | |
| 3,229,916 A | | 1/1966 | Aghnides | |
| 3,334,818 A | | 8/1967 | Moen | |
| 3,672,574 A | | 6/1972 | Knapp | |
| 3,730,440 A | | 5/1973 | Parkinson | |
| 4,637,552 A | * | 1/1987 | Finkbeiner et al. | 239/428.5 |
| 4,730,786 A | * | 3/1988 | Nelson | 239/590.3 |

(Continued)

FOREIGN PATENT DOCUMENTS

| | | |
|---|---|---|
| DE | 196 42 055 | 4/1998 |

(Continued)

*Primary Examiner*—Darren W Gorman
(74) *Attorney, Agent, or Firm*—Volpe and Koenig, P.C.

(57) ABSTRACT

The present invention relates to a jet regulator (1) having a jet fractionating device inside a mounting housing (6). The jet regulator (1) according to the present invention is characterized in that the mounting housing (6) is divided into at least two housing parts (7, 8), and that the housing parts (7, 8) can be connected to one another, and that a housing part (7) at the flow inlet side is connected fixedly and non-releasably with the jet fractionating device (2). The jet regulator (1) according to the present invention is distinguished by a high degree of shape stability and by manufacturing costs that are nonetheless low, even for small housing diameters (see FIG. 1).

33 Claims, 16 Drawing Sheets

U.S. PATENT DOCUMENTS

| | | | | |
|---|---|---|---|---|
| 5,184,641 | A * | 2/1993 | Kuhn | 137/504 |
| 5,769,326 | A * | 6/1998 | Muchenberger et al. | 239/428.5 |
| 5,803,368 | A * | 9/1998 | Shekalim | 239/428.5 |
| 6,126,093 | A | 10/2000 | Grether et al. | |
| 6,152,182 | A * | 11/2000 | Grether et al. | 138/42 |
| 6,588,682 | B1 | 7/2003 | Flieger | |
| 2003/0141384 | A1 | 7/2003 | Grether et al. | |
| 2003/0197072 | A1 | 10/2003 | Flieger | |
| 2004/0050968 | A1 | 3/2004 | Grether et al. | |

FOREIGN PATENT DOCUMENTS

| | | |
|---|---|---|
| DE | 196 47 798 | 5/1998 |
| DE | 200 06 163 | 8/2000 |
| DE | 200 10 101 | 10/2000 |
| EP | 1 076 136 | 6/2000 |
| FR | 1 387 318 | 12/1963 |
| GB | 1 330 201 | 9/1973 |
| WO | WO 83/01266 | 4/1983 |
| WO | WO 95/06787 | 3/1995 |

* cited by examiner

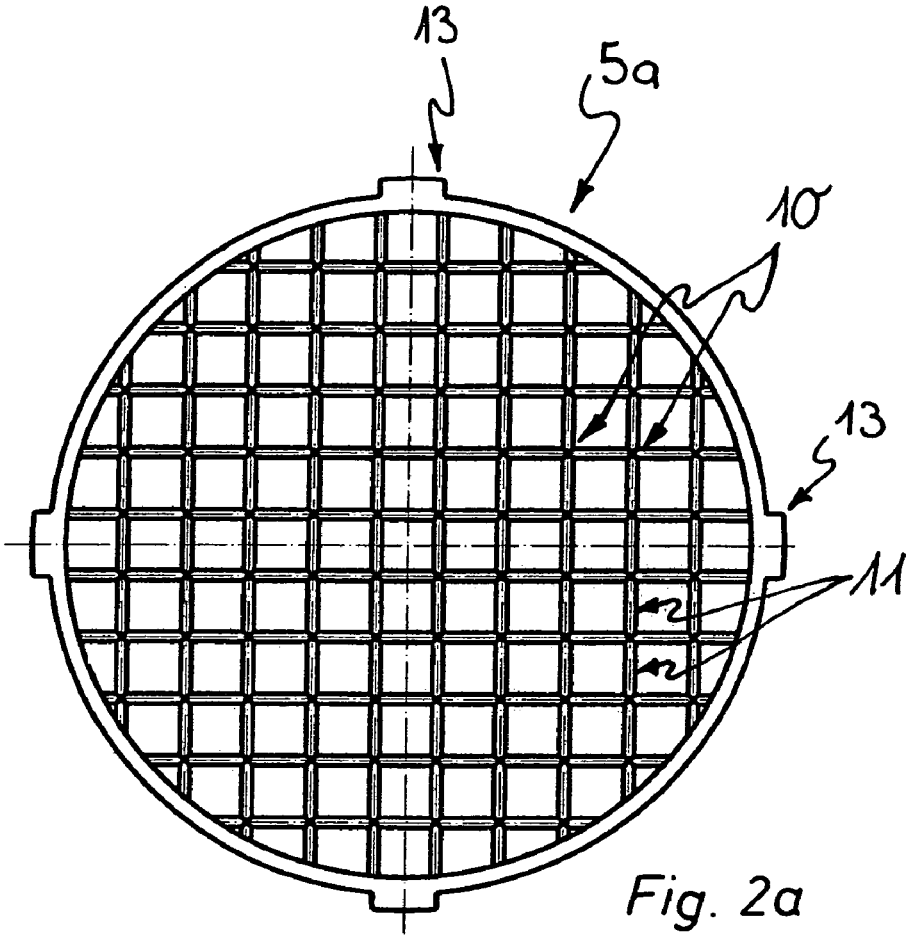
Fig. 2a
Fig. 2b
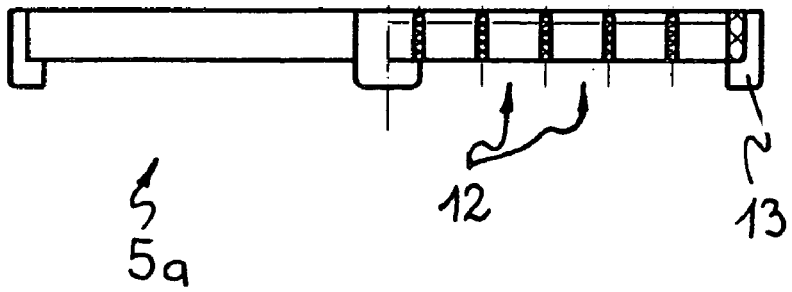

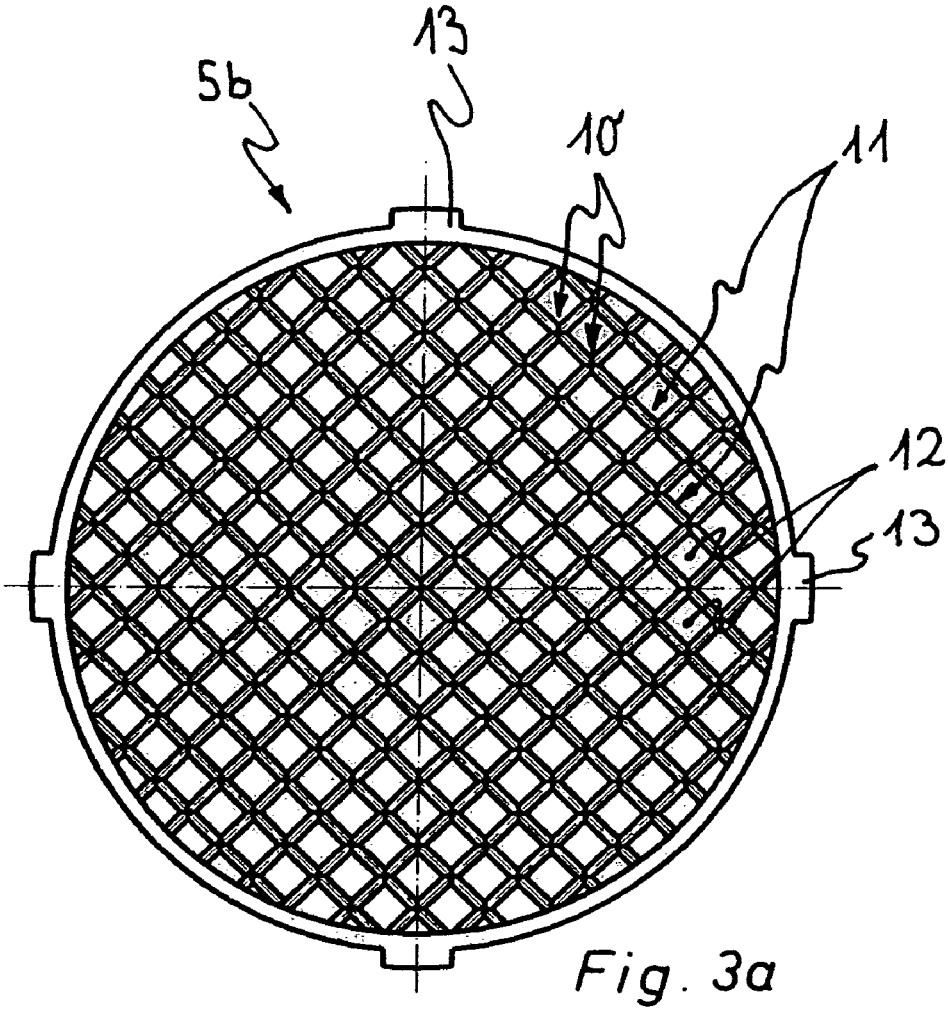
Fig. 3a
Fig. 3b
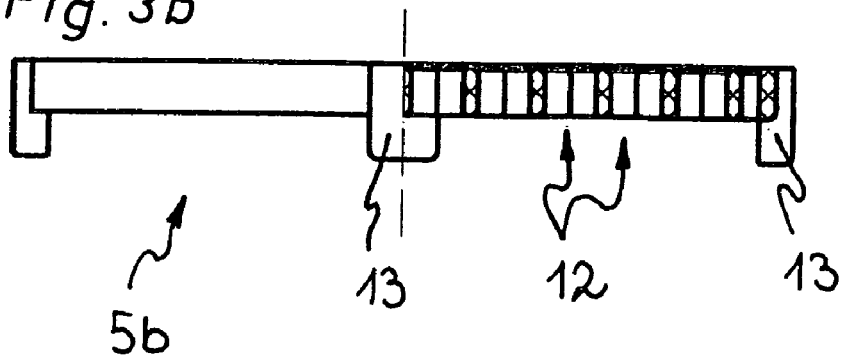

JET REGULATOR

BACKGROUND

The present invention relates to a jet regulator having a mounting case that is divided into at least two case parts that can be connected to one another. A jet regulator of the above-noted type is known for example from DE 30 00 799 A1. The known jet regulator, which can for example be built into the outflow mouth of a sanitary outflow armature, has in the interior of its mounting housing a jet fractionating device, formed as a perforated plate, that divides the inflowing jet of water into a multiple of individual jets. In a jet regulating device, these individual jets are formed (after an admixture of air if necessary) into a homogenous, soft-beading, non-spraying water jet.

In the known jet regulator, the perforated plate that acts as a jet fractionating device is formed as a separate plastic part that can be placed into the mounting housing of the jet regulator from the flow inlet side. In order to enable good fractionation of the inflowing jet of water into the individual jets in the perforated plate, it is desirable that the axial longitudinal extension of the flow holes in the perforated plate be relatively short, thus resulting in a correspondingly small thickness of the perforated plate. However, because the perforated plate, whose plane is oriented transverse to the direction of flow, can be exposed to high water pressures, and because the perforated plate, which is made of plastic, tends to exhibit undesirable deformations that negatively affect its functioning, especially at high water temperatures and if the plate thickness is too small, a certain minimum thickness of the perforated plate is nonetheless required.

From DE-U-200 06 163, a jet regulator of the above-noted type is known whose mounting housing is divided into two housing parts that can be connected to one another. Inside the housing of the known jet regulator, there is provided a flow rectifier, a homogenizing device being connected downstream in the direction of flow from this flow rectifier. While the flow rectifier directs the individual jets flowing in the line cross-section in approximately the same direction of flow, these individual jets flowing in the same direction are subsequently combined in the homogenizing device to form a homogenous, soft-beading, non-spraying water jet. Here, the flow rectifier, which is comparatively large and has significantly larger flow openings in comparison with the subsequent homogenizing device, is connected fixedly and non-releasably with the case part at the flow inlet side of the mounting case.

Because a flow rectifier for the regular orienting of the individual jets must also have a comparatively large axial longitudinal extension, and thus a correspondingly large plate thickness, the plate-shaped flow rectifier, which is provided with through-holes, of the jet regulator known from DE-U-200 06 163 is sufficiently stable to withstand high water pressures on its own. Because the jet regulator known from DE-U-200 06 163 does not have a jet fractionating device, in this known prior art the problems stated above in relation to DE 30 00 799 A1 do not arise here.

The object therefore arises of creating a jet regulator of the type named above, having a jet fractionating device, said jet regulator being distinguished by a high degree of stability in its shape, even at small housing diameters, while nonetheless being inexpensive to manufacture.

In the jet regulator of the type named above, the solution according to the present invention of this problem is to be found in the features recited in patent claim 1.

The jet regulator according to the present invention comprises a jet fractionating device, to which there is connected downstream, at the flow outlet side, a jet regulating device and/or a flow rectifier. So that this jet fractionating device can divide the inflowing water jet into a multiplicity of individual jets, the flow holes of the jet fractionating device have a smaller inner diameter in comparison with the flow openings of the jet regulating device, or of the jet rectifier. In contrast to the prior art known from DE 30 00 799 A1, which, unlike the jet regulator known from DE-U-200 06 163, likewise has a jet fractionating device, the jet fractionating device of the jet regulator according to the present invention is connected fixedly and non-detachably with a case part at the flow inlet side. Because a sensitive jet fractionating device, for example a thin perforated plate, is also connected at its peripheral edge with the case part in a secure, fixed, and protected manner, no significant deformation of the jet fractionating device, negatively affecting its functioning, is to be expected, even at hot water temperatures and high water pressures. Because the jet fractionating device of the jet regulator according to the present invention is held fixedly and non-detachably on the inner case wall, and because an annular flange is no longer required there as a support for the jet fractionating device, the jet regulator according to the present invention can be constructed with a comparatively small case diameter even for high flow rates; in the prior art known from DE 30 00 799 A1, this was possible only in jet regulators having low flow rates. Due to the jet fractionating device, connected fixedly with the mounting housing, the mounting housing experiences a radial stiffening that also makes the sleeve-shaped mounting housing more stable and resistant to breakage overall. While in known jet regulators, in which a separate perforated plate was mounted in the external housing as a jet fractionating device, sealing problems constantly arose between the perforated plate and the sleeve-shaped external housing, the jet regulator according to the present invention offers the essential advantage that these sealing problems do not arise, due to the fact that the jet fractionating device and the housing part at the flow inlet side are constructed in one piece. Because the mounting housing is made of at least two housing parts that can be connected to one another, it is nonetheless possible as needed to place a jet regulating device, connected downstream from the perforated plate in the direction of flow, and additional required functional units as needed, into the mounting housing. The jet regulator according to the present invention is therefore distinguished by a high degree of shape stability while at the same time having a low manufacturing cost.

In order to make it possible to construct the jet regulator according to the present invention in modular form if necessary, and in order to be able to exchange the functional units situated in at least one of its housing parts as needed, it can be advantageous if at least two housing parts can be connected to one another in releasable fashion.

As a jet fractionating device, any suitable design can be used that divides the jet of water flowing into the jet regulator into a multiplicity of individual jets. In this way, the jet fractionating device can for example also be realized as a baffle plate. In a preferred specific embodiment according to the present invention, however, it is provided that the jet fractionating device is formed as a perforated plate.

Insofar as a strong or less strong braking of the flow of water in the jet regulator according to the present invention is desired, it is possible to adapt the jet regulator by exchanging the jet regulating device as well as the functional units connected downstream therefrom. A preferred specific embodiment of the present invention therefore provides that at least two jet regulating devices that can optionally be placed into the mounting housing are allocated to the mounting housing, which is made up of at least two housing parts that can be connected to one another.

The housing part at the flow inlet side of the jet regulator according to the present invention can be manufactured at low expense as a one-piece plastic injection-molded part, if the jet fractionating device is connected in one piece with the housing part allocated thereto.

The expense associated with the manufacture of the jet regulator according to the present invention is further reduced if the mounting housing has two adjacent housing parts that can be connected to one another in a dividing plane oriented transverse to the inflow direction.

It is possible for at least two housing parts of the jet regulator according to the present invention to be connected with one another for example by gluing or welding.

However, the housing parts of the jet regulator according to the present invention can be connected to one another in a particularly simple and convenient fashion if the housing parts of the mounting housing can be locked with one another in releasable fashion.

A preferred specific embodiment of the present invention provides that a housing part at the flow outlet side is constructed in the form of a sleeve, and that at least one insert part of the jet regulating device or a functional unit of this sort can be placed into this housing part. Here, it is advantageous if the at least one insert part can be placed into the housing part allocated to the functional unit from the flow inlet side of this housing part, up to an insert stop or a support.

In order to make it possible to easily adapt the jet regulator according to the present invention to a wide range of requirements, while using the same mounting housing, a plurality of jet regulating devices that can optionally be placed into the mounting housing can be allocated to this mounting housing. In addition, or instead of this, it is possible for the jet regulating device of the jet regulator to have a modular construction, and for a plurality of insert parts that can optionally be combined with one another to be allocated to this jet regulating device.

In a specific embodiment, warranting separate protection, of the jet regulator according to the present invention, it is provided that the jet regulating device comprises at least one insert part that can be placed into the mounting housing and that has webs that are oriented transverse to the direction of flow and that delimit between them through-openings, and that the webs of at least one insert part are disposed in the fashion of a grid or net, intersecting at intersect nodes.

In the interior of its mounting housing, this jet regulator has a jet regulating device that has at least one insert part that can be placed into the mounting housing. This at least one insert part has webs that are situated in a plane oriented transverse to the direction of flow, with the webs being disposed in the manner of a grid or net, intersecting at intersect nodes. Due to this grid- or net-type structure, the at least one insert part can comprise a large number of webs even on a comparatively small cross-sectional surface, which separate the incoming jet of water into a multiplicity of individual jets. Thus, an effective mixing and jet regulation can be achieved even with high flow rates on a comparatively small cross-sectional surface. Even given a large number of webs, these webs can be disposed in the fashion of a grid or net in such a way that the through-openings are nonetheless sufficiently large to allow dirt particles carried along in the stream to pass.

A preferred specific embodiment according to the present invention provides that the at least one insert part of the jet regulating device is situated relative to the jet fractionating device in such a way that the individual jets produced in the jet fractionating device impinge on intersect nodes of the at least one insert part.

In order to additionally increase the effectiveness of the dividing of the individual jets, and in order to additionally improve the jet regulating properties even for the smallest cross-sectional surface, it is advantageous if at least two adjacent insert parts are provided that have webs that are disposed in the manner of a grid or net. In this specific embodiment, the jet regulating device comprises at least two insert parts having webs that intersect at intersect nodes in, for example, the manner of a grid. At these intersect nodes, each individual jet of water is again effectively divided into a plurality of individual jets in such a way that an effective mixing and jet regulation can be achieved even at high flow rates and with a comparatively small cross-sectional surface of the inventive jet regulator.

A specific embodiment of the present invention thereby provides that the webs and intersect nodes of the at least two adjacent insert parts align with one another. A particular advantage of such a specific embodiment is that at least two insert parts can be identical in construction.

In another specific embodiment that represents a further development of the present invention, distinguished by an especially effective division of the water jets in the smallest space, it is provided that the intersect nodes of an adjacent insert part are connected downstream in the direction of flow from the through-openings of the insert part to which it is adjacent.

A simple specific embodiment according to the present invention that can be manufactured at low cost provides that at least one insert part, situated at the flow inlet and/or flow outlet side, has a grid-type construction, and comprises two intersecting sets of parallel grid webs. In addition, or instead of this, an insert part at the flow inlet and/or flow outlet side can have a set of radial webs that intersect at the intersect nodes with a set of webs that are arranged concentrically or in annular fashion. According to a further proposal of the present invention, it is provided that an insert part at the flow inlet side and/or an insert part at the flow outlet side has webs that intersect in stelliform fashion, or in the manner of a net.

However, it is also possible that the webs of at least one insert part form a honeycomb-shaped grid structure.

A construction of the jet regulator according to the present invention that saves space in the axial direction as well is favored if the webs of at least one insert part are situated in a plane that is preferably oriented transverse to the direction of flow, and if in particular the insert parts have a plate-shaped design. In order to unite, at the flow outlet side, the individual jets produced in the jet regulating device to form a homogenous non-spraying overall jet, it is advantageous for the width of the through-openings of the flow rectifier to be smaller than their length in the direction of flow. Here it is particularly useful for the flow rectifier to be situated at the exit end of the mounting case.

The flow rectifier can be connected in one piece with the mounting housing, or can be placed into the mounting housing as a separate insert part. While a jet regulator that can be placed into the mounting housing as a separate insert part further supports the modular design of the jet regulator according to the present invention, a flow rectifier connected in one piece with the mounting housing can also act as a guard against vandalism of the jet regulator at the flow outlet side.

The flow rectifier of the jet regulator according to the present invention can also be adapted in its construction to the particular housing of application and the purpose of use. Thus, it can for example be provided that the flow rectifier has through-openings that are rectangular, shaped as segments of a circle, or honeycomb-shaped.

However, it is also possible for the flow rectifier and/or the jet regulating device to comprise at least one metal sieve.

The effectiveness of the jet regulating device used is further increased if the intersect nodes of an insert part of the jet regulating device that immediately follows the perforated plate are connected downstream from the through-holes of the perforated plate.

A preferred specific embodiment according to the present invention provides that the housing part at the outflow side has a soft and/or water-repellent surface at least in the area of the water exit opening. The advantage of this specific embodiment consists in the freedom from calcification in the area of its water exit opening. In addition, a soft surface is easy to clean, in particular by manual stripping off of deposits that may accumulate.

For the same reasons, it can be advantageous if, in addition to or instead of the measure just described, the housing part at the outflow side is manufactured from an elastic material, at least in the area of the water exit opening. Here, rubber, silicon, thermoplastic elastomers, or other rubber-like materials are preferably to be used.

In order to promote simple manufacture of the jet regulator according to the present invention even in the area of its housing part at the outflow side, it is advantageous if the housing part at the outflow side is made essentially of an elastic material and/or a material having a surface that is soft or that repels water.

So that a housing part made from a rubber-like material is inherently sufficiently stable, and can also be fastened to the adjacent housing part by, for example, a locking connection, it is advantageous if the housing part at the outflow side is reinforced by longitudinal webs that are preferably distributed uniformly in the circumferential direction.

A preferred specific embodiment according to the present invention thereby provides that the longitudinal webs are provided at least in the area of the exit opening.

A particularly advantageous development according to the present invention, warranting separate protection, provides that the housing part at the outflow side comprises, in the area of the water exit opening, at least one constriction or similar narrowing of its flow cross-section. This constriction or similar narrowing of the flow cross-section has a calibrating effect on the outflowing jet of water and its flow pattern. The narrowing of the flow cross-section is provided in the area of the water exit opening, and thus in an area that is connected downstream from possible disturbing contours in the direction of flow. The calibration of the water jet significantly promotes a homogenous, non-spraying, and low-noise flow pattern.

In order to further simplify the manufacture of the jet regulator according to the present invention, it is advantageous if the housing part at the outflow side can be connected with the housing part that is adjacent at the flow inlet side, preferably via a locking connection, in particular a peripheral one.

Additional features of the present invention result from the following description of exemplary embodiments of the present invention, in connection with the claims and the drawing. The individual features can be realized individually or in combination in a specific embodiment of the present invention.

BRIEF DESCRIPTION OF THE DRAWINGS

FIG. 2 shows an insert part of the jet regulating device in a top view (FIG. 2*a*) and in a longitudinal section (FIG. 2*b*), the insert part having webs that intersect at intersect nodes in the manner of a grid, FIG. 3 shows an insert part comparable to that shown in FIG. 2, in a top view (FIG. 3*a*) and in a longitudinal section (FIG. 3*b*)

DETAILED DESCRIPTION OF THE PREFERRED EMBODIMENTS

Figure 1:
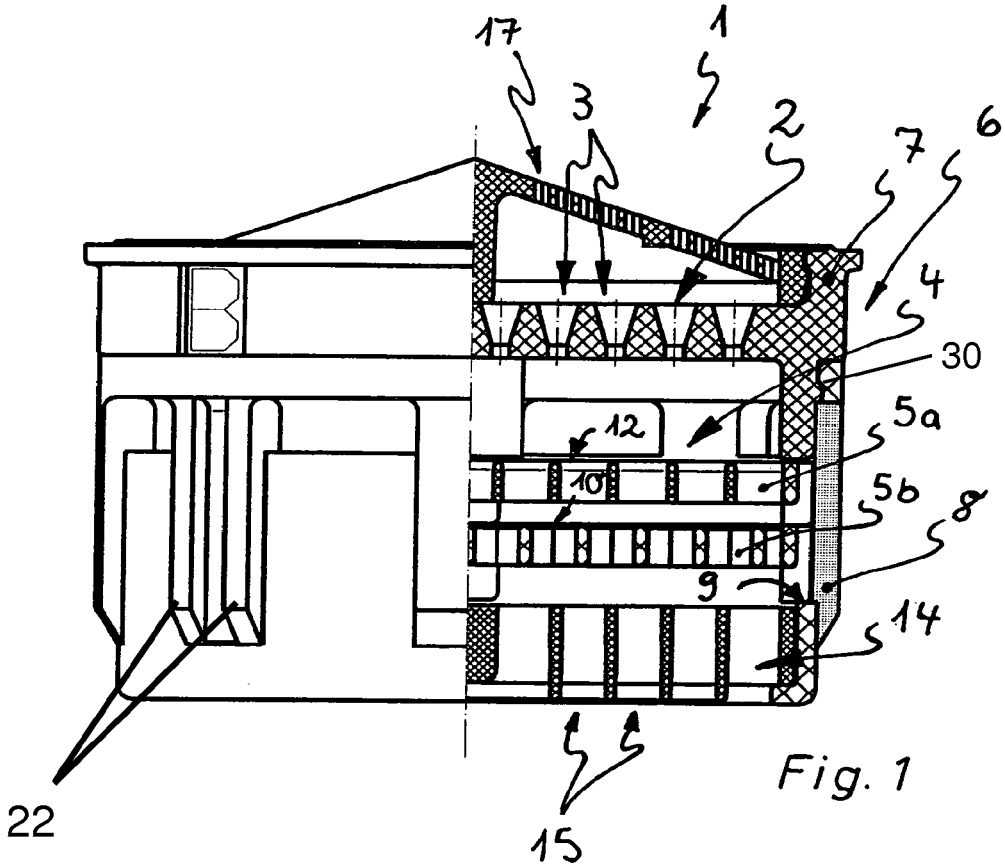
FIG. 1 shows a sanitary fitting, constructed as a jet regulator, in a longitudinal section, comprising a jet fractionating device at the flow inlet side, to which a jet regulating device is connected downstream in the direction of flow that has a plurality of insert parts situated at a distance from one another, and a flow rectifier forms the end of this jet regulator at the flow outlet side.

FIG. 1 shows a sanitary fitting that can be placed into the outflow mouth of a sanitary outflow armature. The insert part is here formed as jet regulator 1, which is used to produce a homogenous, soft-beading, non-spraying jet of water. For this purpose, jet regulator 1 has a jet fractionating device 2 that is fashioned as a perforated plate and that divides the inflowing jet of water into a multiplicity of individual jets. For this purpose, perforated plate 2 has a corresponding number of flow holes 3 that, at least in a section of the holes at the flow inlet side, are tapered in the direction of flow, preferably conically. So that dirt particles cannot penetrate into fitting 1 and cause functional disturbances there, a sieve attachment 17 is provided at the flow inlet side.

A jet regulating device 4 is connected downstream, in the direction of flow, from the jet fractionating device formed by perforated plate 2. This jet regulating device 4 is intended to strongly brake the individual jets coming from jet fractionating device 2, to divide them into further individual jets, and, if required, to promote an admixture of air, in order finally to achieve a soft-beading water jet. For this purpose, jet regulating device 4 comprises two insert parts 5*a*, 5*b*, which can be placed into the case housing 6 at a distance from one another.

In FIG. 1, it can be seen that the case housing 6 has a two-part construction, and has two housing parts 7, 8 that can be snap-fit together in releasable fashion. Here, housing part 7 at the flow inlet side is connected in one piece, and therefore in fixed and non-releasable fashion, with perforated plate 2. These housing parts 7, 8 are connected with one another in releasable fashion in a dividing plane oriented transverse to the inflow direction. Because a comparatively thin perforated plate 2 is also connected securely and fixedly with housing part 7 at its peripheral edge, no significant deformation of perforated plate 2, having an adverse effect on functioning, is to be expected, even at hot water temperatures and high water pressures. Because perforated plate 2 is held fixedly and non-detachably on the housing inner wall, and because an annular flange is not required there as a support for the perforated plate, the jet regulator 1 can be formed with a comparatively small housing diameter, even for high flow rates, at high pressures and high temperatures; in the known prior art, this was possible only in jet regulators having low flow rates, at low pressures and low temperatures. Due to perforated plate 2, which is connected fixedly with mounting housing 6, mounting housing 6 experiences a radial stiffening that makes sleeve-type mounting housing 6 more resistant to breakage and more stable in shape overall. Because the mounting housing is made of at least two housing parts 7, 8 that can be connected with one another in releasable fashion, jet regulating device 4, which is connected downstream from perforated plate 2 in the direction of flow, can nonetheless be placed into the housing 6, as can additional functional units, if required. Jet regulator 1 is therefore distinguished by a high degree of shape stability, while simultaneously having a low manufacturing cost. Because jet regulator 1 can be constructed with a comparatively small housing diameter even for high flow rates, at high pressure and high temperature it is also possible to use the same mounting housing 6 for different flow classes. To the extent that different flow rates require a corresponding adaptation of jet regulator 1, this can be achieved by exchanging the jet regulating devices connected downstream from perforated plate 2, and similar functional units.

Figure 4:
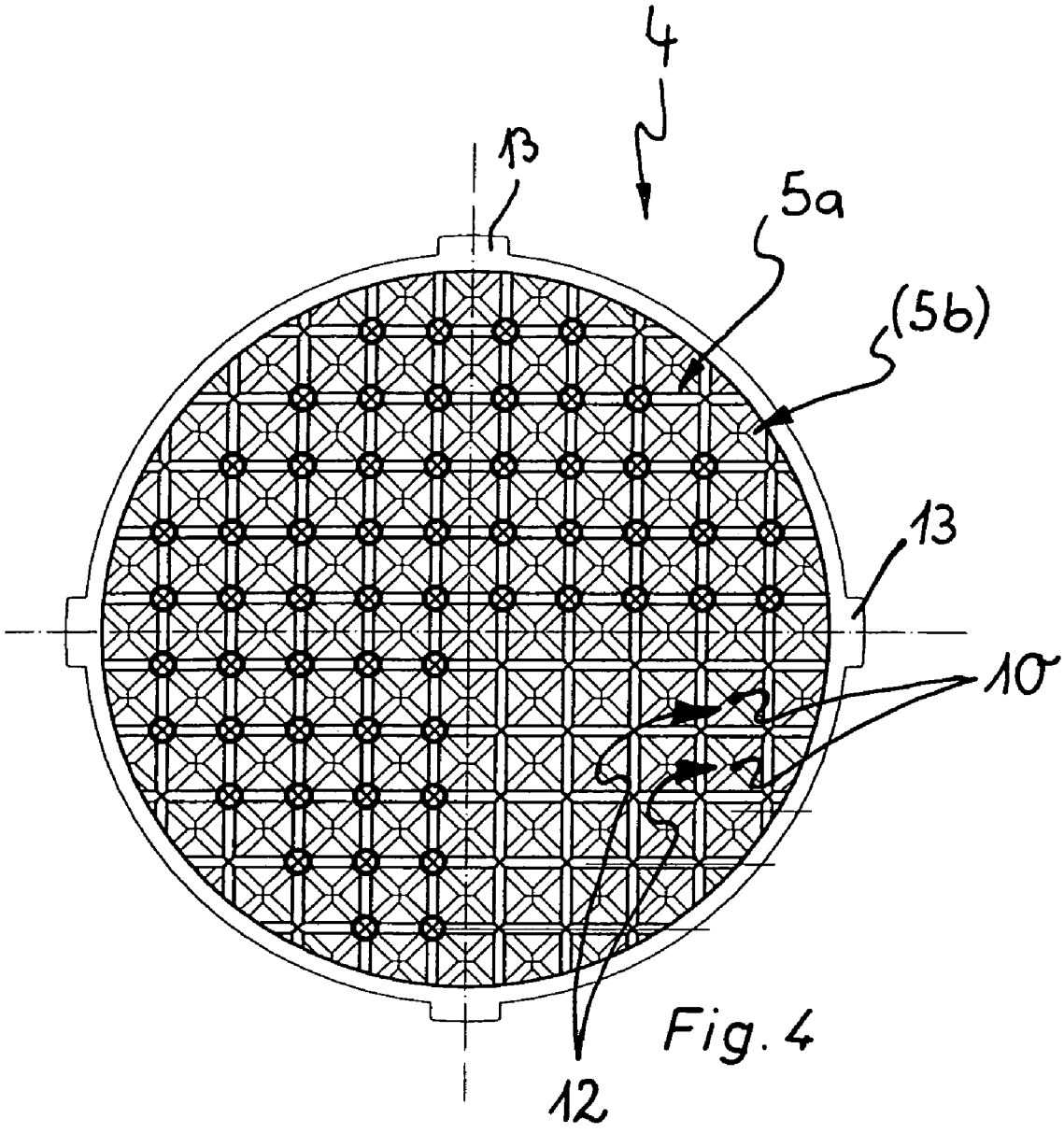
FIG. 4 shows the insert parts, combined with one another to form the jet regulating device, from FIGS. 2 and 3, in a top view.

In FIG. 1, it can be seen that the housing part 8 at the flow outlet side is constructed in the manner of a sleeve, and that insert parts 5*a*, 5*b* of jet regulating device 4 can be placed into this housing part 8 up to an insertion stop 9. From a comparison of FIGS. 2 to 8, and in particular from FIGS. 4 and 7, it is clear that insert parts 5*a*, 5*b* each have webs 11 that intersect at intersect nodes 10, the intersect nodes 10 of adjacent insert part 5*b* being situated downstream in the direction of flow from the through-openings 12 of one of these insert parts, while at the same time intersect nodes 10 of adjacent insert part 5*a* at the flow inlet side are situated upstream in the direction of flow from through-openings 12 of insert part 5*b* at the flow outlet side.

The water jet, flowing in against insert part 1 fashioned as a jet regulator, is divided into a plurality of individual jets at each intersect node 10 of insert part 5*a* at the flow inlet side. At intersect nodes 10 of downstream (in the direction of flow) insert part 5*b*, these individual jets are again divided into a multiplicity of further individual jets. Jet regulating device 4 of jet regulator 1, whose intersect nodes 10 of its insert parts 5*a*, 5*b* are disposed in cascading fashion, is distinguished by a particularly effective braking of the inflowing water jet, even with the smallest cross-sectional surface.

Jet regulating device 4 of jet regulator 1 (shown here) has a modular construction. A plurality of insert parts 5 that can optionally be combined with one another are allocated to jet regulating device 4. Thus, insert parts 5*a* and 5*b* shown in FIGS. 2 and 3 comprise grid-shaped webs 11. The grid structures of these insert parts 5*a*, 5*b* are offset to one another by approximately 45°, and insert part 5*b*, shown in FIG. 3, has a smaller grid spacing in comparison with insert part 5*a* from FIG. 2. A correct positioning of insert parts 5 in relation to one another in mounting housing 6 is ensured at all times by position-orienting projections or recesses 13 on the outer peripheral edge of insert parts 5*a*, 5*b*, working together with position-orienting recesses or projections on the housing inner periphery of the housing part 8.

Figure 5A:
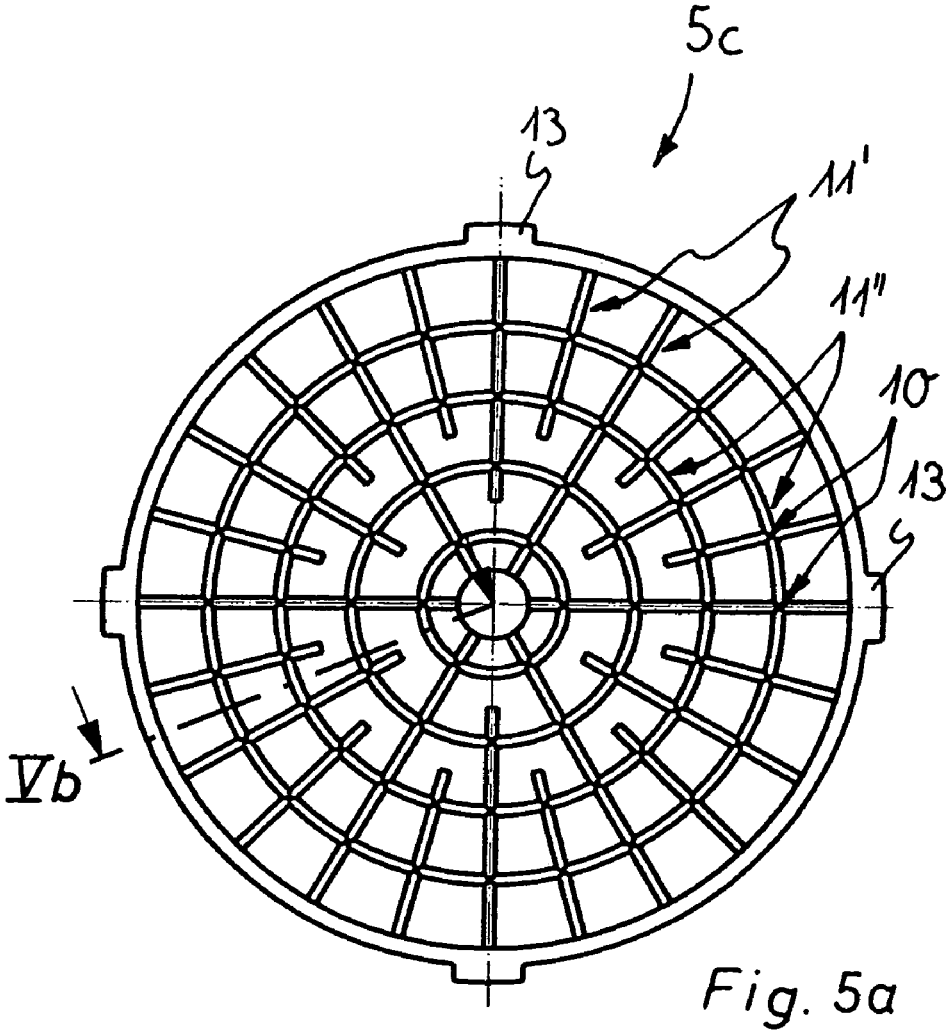
FIG. 5 shows an insert part, in a top view (FIG. 5*a*) and in a longitudinal section (FIG. 5*b*), having two groups of webs that intersect at intersect nodes, one group having nodes that are disposed concentrically, while a second group is made up of radial webs.
Figure 5B:
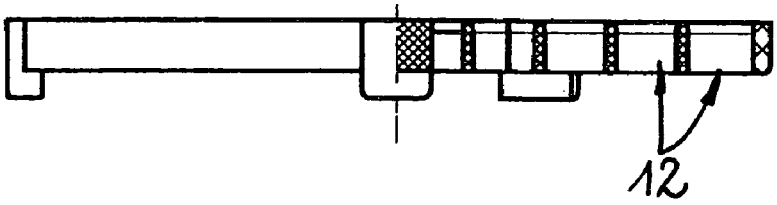
Figure 6A:
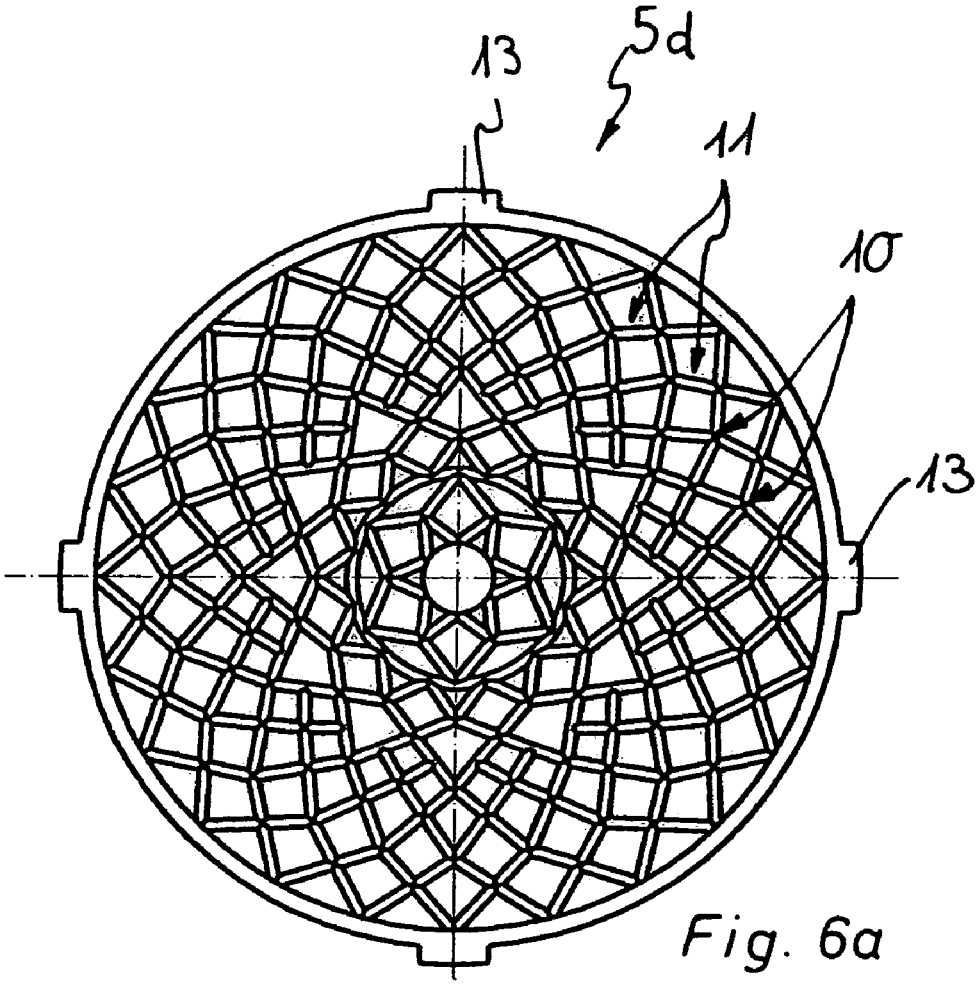
FIG. 6 shows an insert part in a top view (FIG. 6*a*) and in a longitudinal section (FIG. 6*b*), having webs that are connected with one another at intersect nodes in the manner of a net.
Figure 6B:
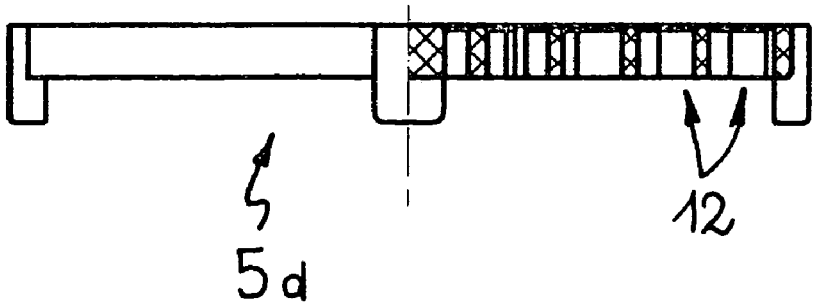
Figure 7A:
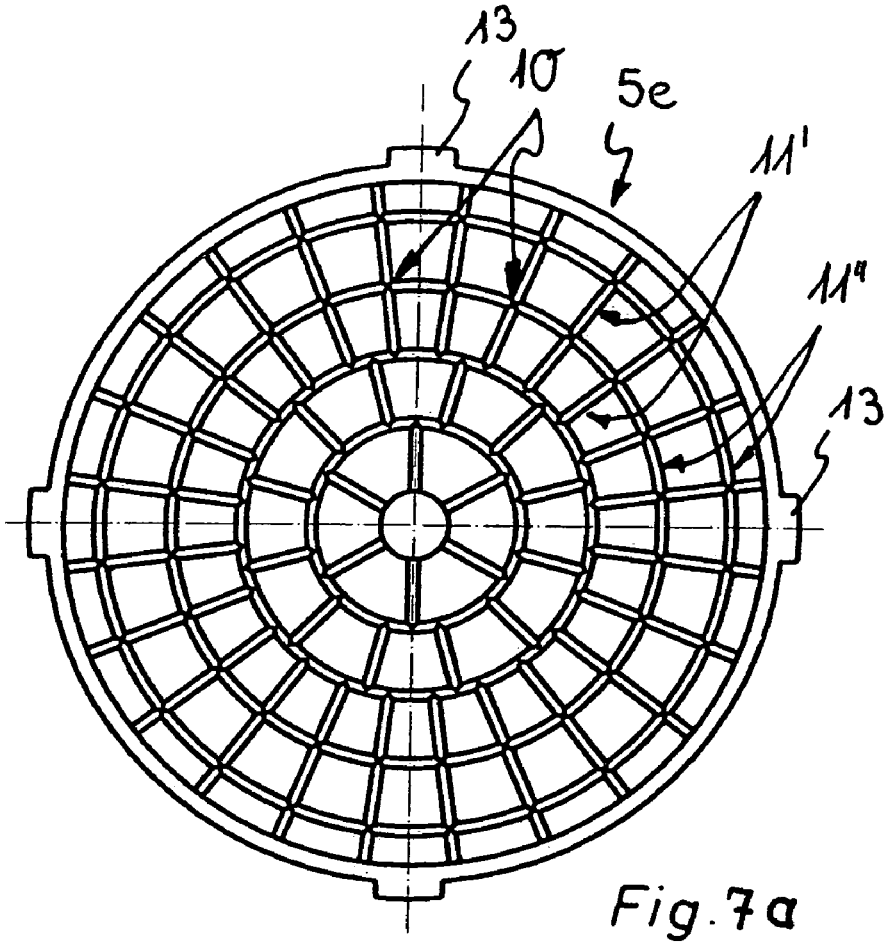
FIG. 7 shows an insert part comparable to the one shown in FIG. 5, in a top view (FIG. 7*a*) and in longitudinal section (FIG. 7*b*)
Figure 7B:
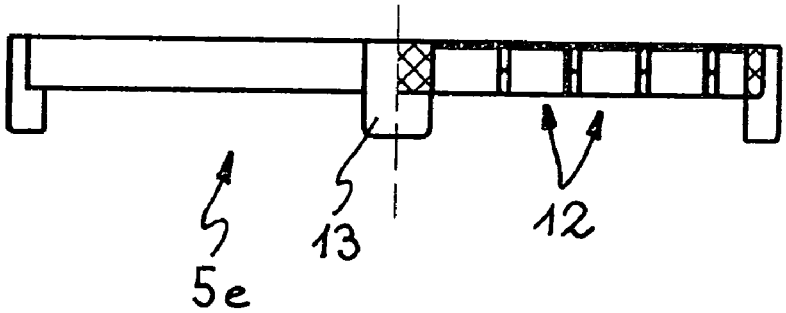
Figure 8:
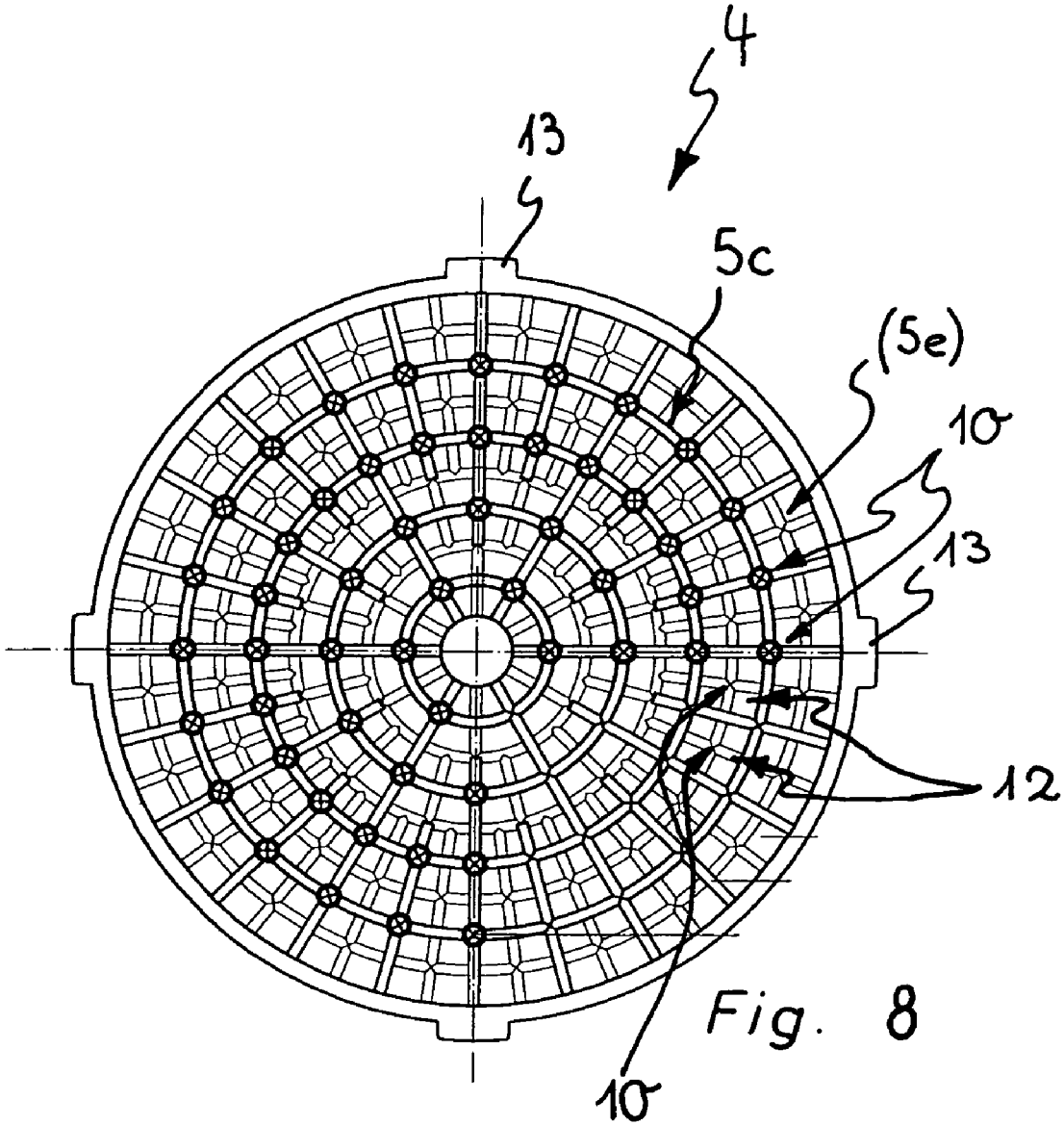
FIG. 8 shows the insert parts, combined to form the jet regulating device, from FIGS. 5 and 7, in a top view.

While flow inlet-side insert part 5*c*, shown in FIG. 5, comprises a set of radial webs 11' that intersect at the intersect nodes with a set of concentric annular webs 11", flow outlet-side insert part 5*d*, shown in FIG. 6, has stelliform or net-shaped intersecting webs 11. The webs 11 of each plate-shaped insert part 5 are situated in a plane that is oriented transverse to the direction of flow.

Figure 9A:
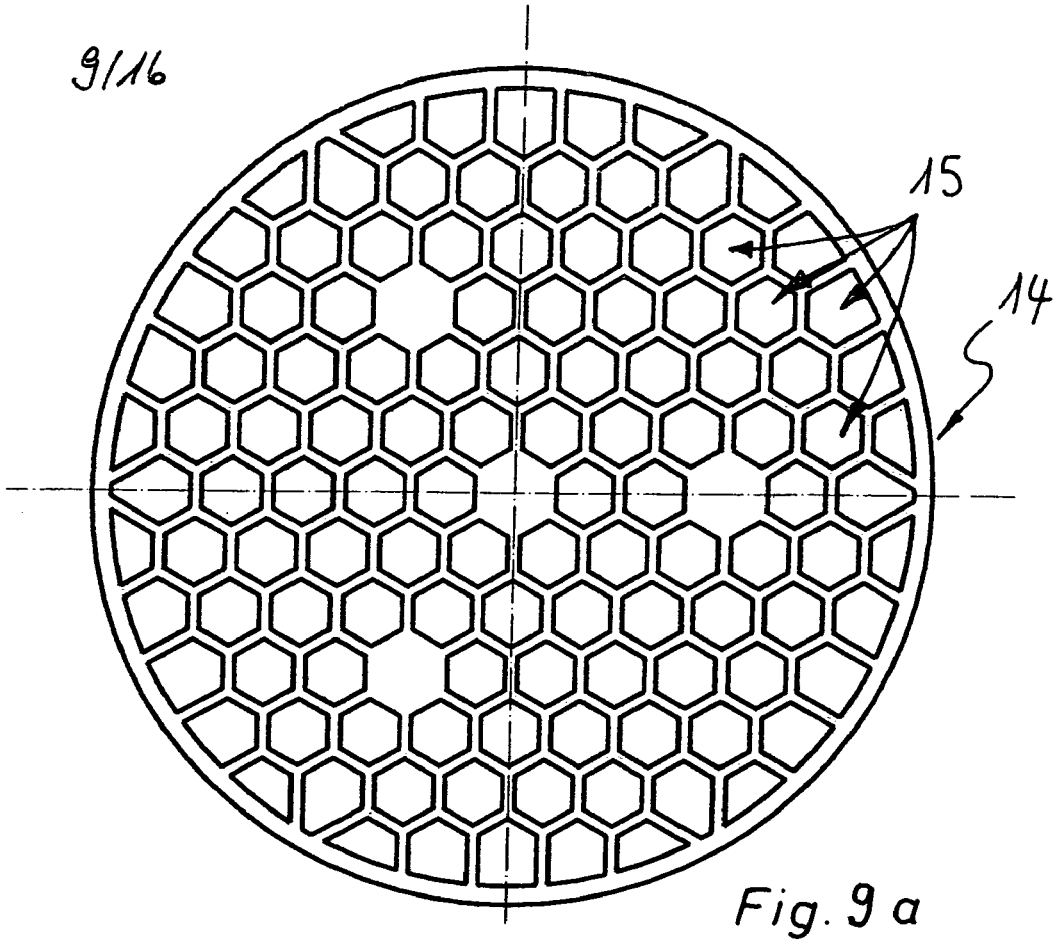
FIG. 9 shows a flow rectifier that can be placed into the housing of the fitting, having honeycomb-shaped flow openings, in a top view (FIG. 9*a*) and in longitudinal section (FIG. 9*b*)
Figure 9B:
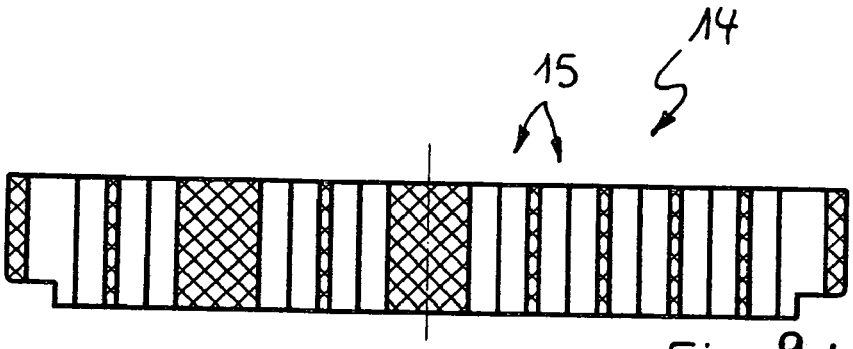
Figure 10A:
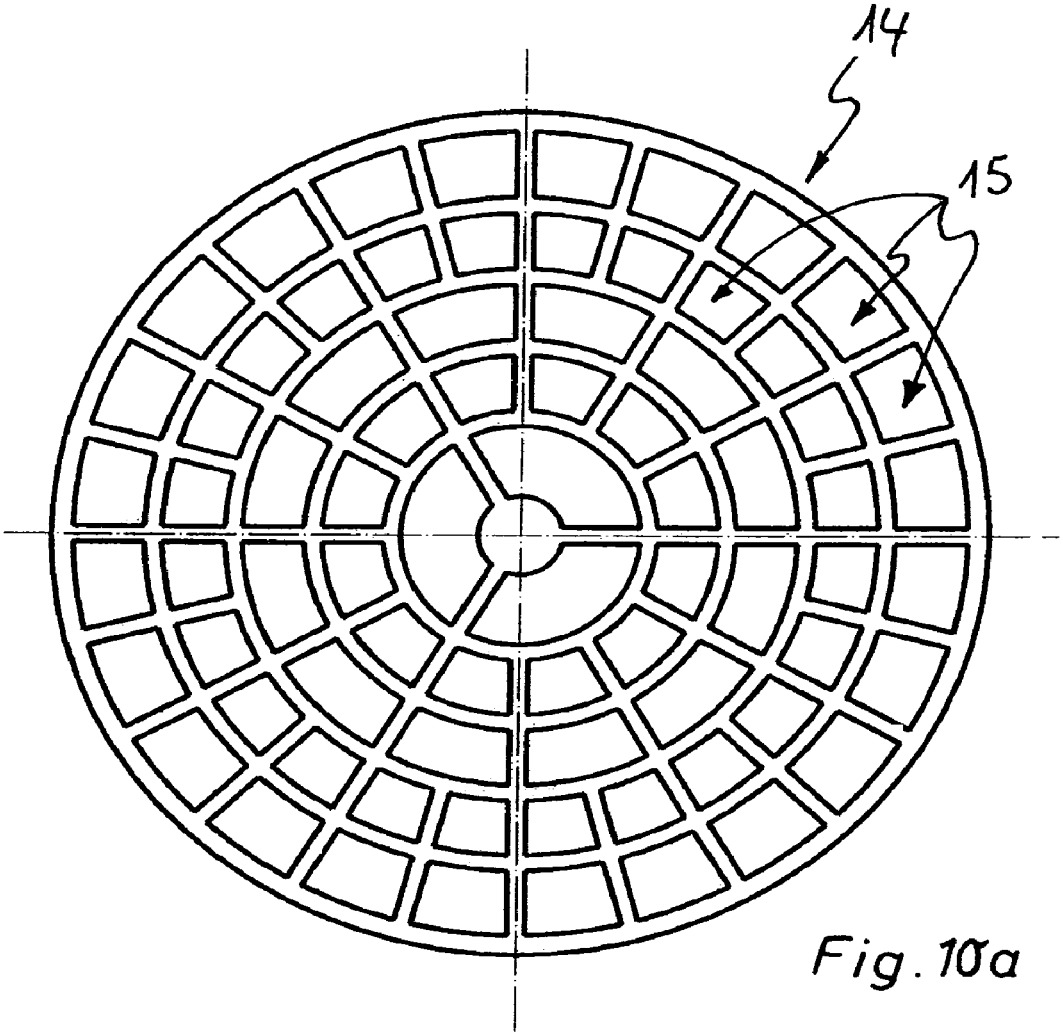
FIG. 10 shows a flow rectifier that is functionally comparable to the one shown in FIG. 9, in a top view (FIG. 10*a*) and in longitudinal section (FIG. 10*b*), the flow rectifier having flow openings in the shape of segments of a circle.
Figure 10B:
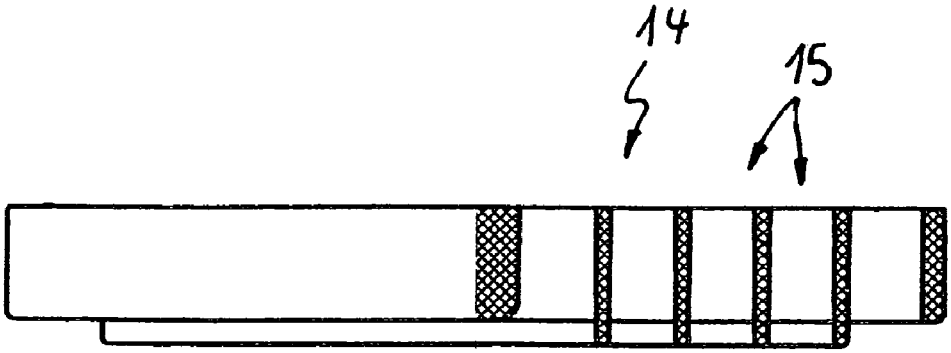

In FIG. 1, it can be seen that a flow rectifier 14 is connected downstream from jet regulating device 4 at the exit end of mounting housing 6. From a comparison of FIGS. 9 and 10, it can be seen that this flow rectifier 14, in which the width of through-openings 15 is smaller than their length in the direction of flow, can have through-openings 15 that are for example honeycomb-shaped (FIG. 9) or shaped as segments of a circle (FIG. 10).

Figure 11A:
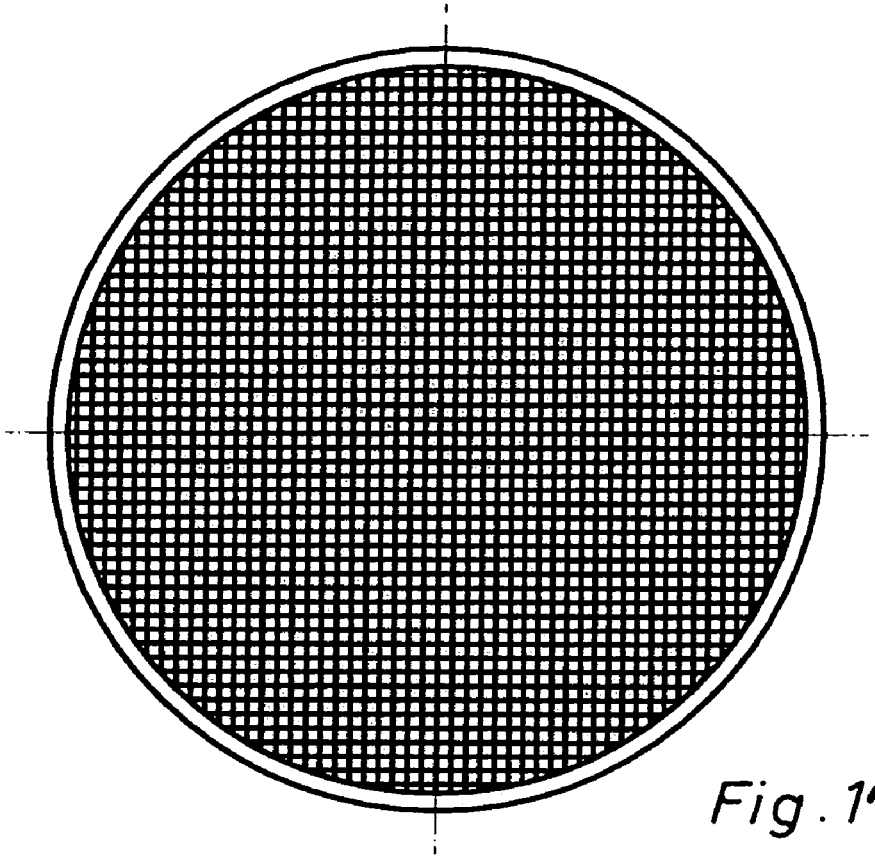
FIG. 11 shows, in a top view (FIG. 11*a*) and in longitudinal section (FIG. 11*b*), a sieve-type insert whose webs are formed by a metal sieve, this insert being capable of being placed in the mounting housing in addition to, or instead of, the insert parts shown in FIGS. 2, 3, 5, 6, and 7, and/or in addition to or instead of the flow rectifier shown in FIGS. 9 and 10.
Figure 11B:
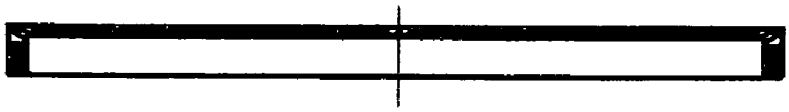
Figure 12A:
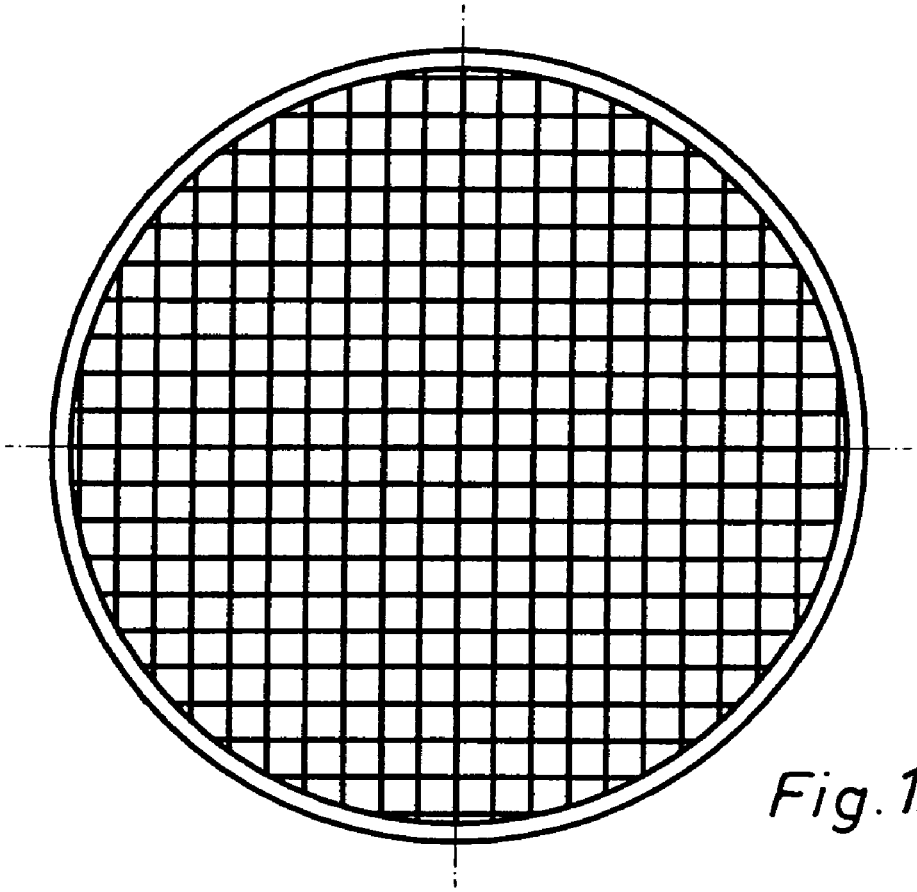
FIG. 12 shows an insert that is functionally comparable to the one shown in FIG. 11, in a top view (FIG. 12*a*) and in longitudinal section (FIG. 12*b*); here, similar to FIG. 11, the insert also has a metal sieve oriented transverse to the direction of flow.
Figure 12B:
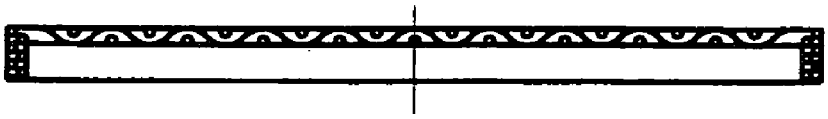

FIGS. 11 and 12 show inserts acting here as flow rectifiers, comprising a grid-shaped metal sieve.

Figure 13:
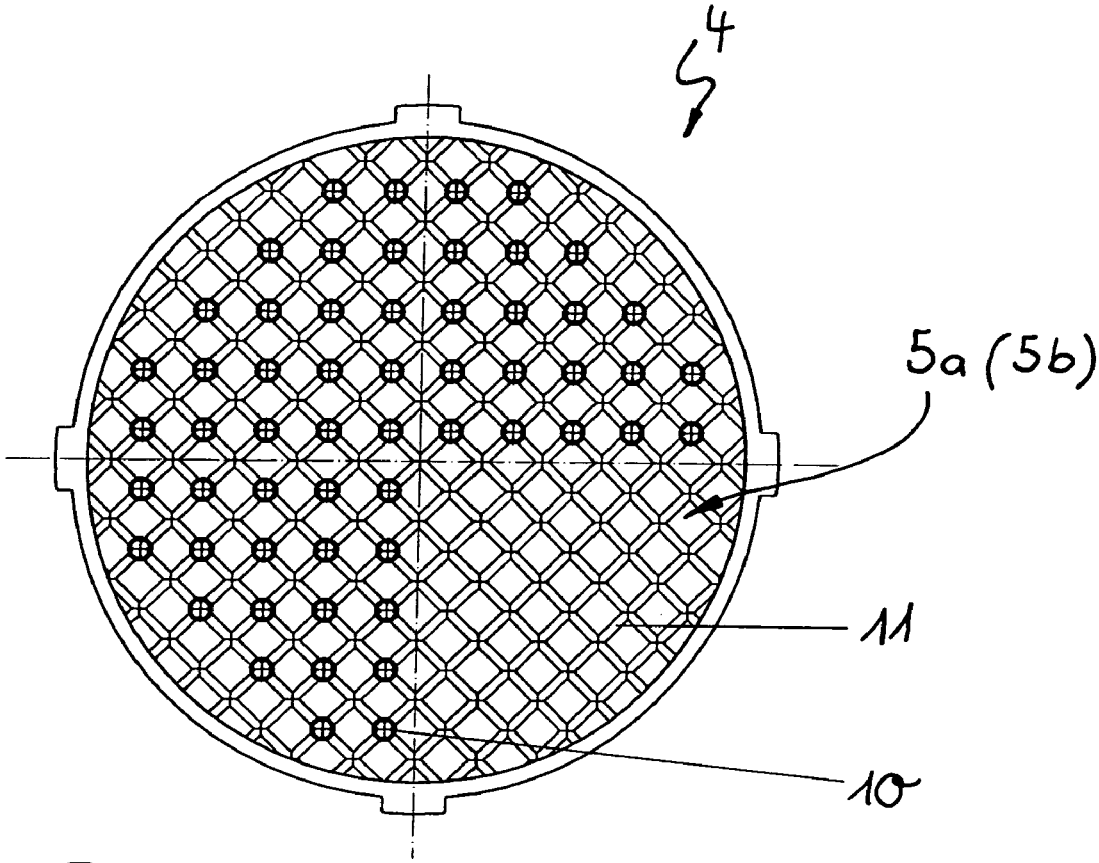
FIG. 13 shows two insert parts, having identical construction, of a jet regulating device, in a top view; the webs and intersect nodes of these adjacent insert parts align with one another.

FIG. 13 shows that jet regulating device 4 can also have two adjacent insert parts 5*a*, 5*b* whose webs 11 and intersect nodes 10 align with one another. Here, it is clear from FIG. 13 that insert parts 5*a*, 5*b* of such a jet regulating device 4 can also be formed with identical construction, further reducing manufacturing costs. As in FIGS. 4 and 8, in FIG. 13 circles printed in bold indicate that the flow openings of perforated plate 2 align with the intersect nodes 10 of at least one insert part that is connected downstream in the direction of flow. The circles printed in bold in FIG. 13 illustrate the impingement points of the individual jets coming from jet fractionating device 2 on intersect nodes 10 of insert part 5*a*.

Figure 14:
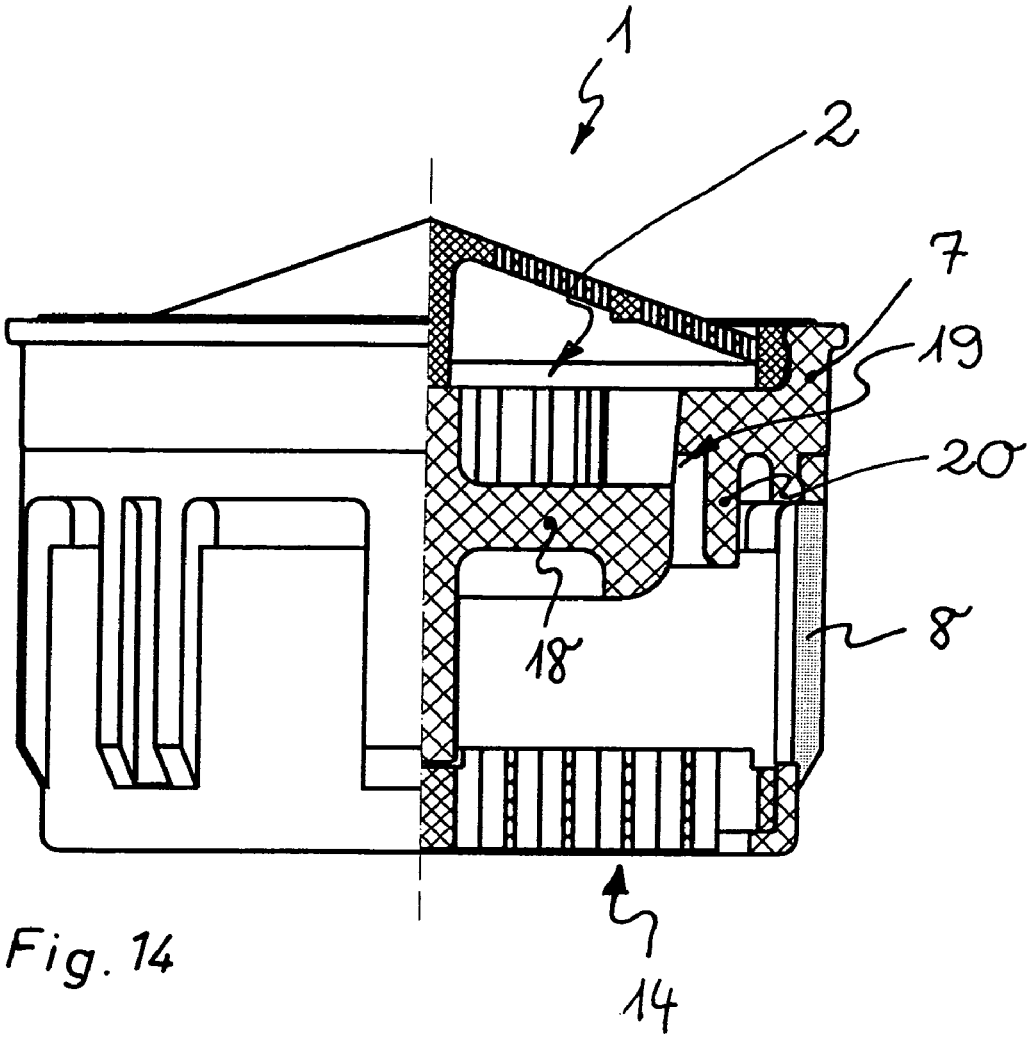
FIG. 14 shows, in partial longitudinal section, a jet regulator that does without a jet regulating device in the interior of its housing.

From FIG. 14, it can be seen that, if necessary, jet regulator 1 can also be used without a jet regulating device situated downstream from jet fractionating device 2. Here, jet fractionating device 2 of jet regulator 1, shown in FIG. 14, is not realized as a perforated plate, but rather has a central baffle plate 18 having radially oriented flow openings 19 on its edge. These radially oriented flow openings 19 are directed towards a peripheral wall 20 that is constructed so as to be open towards the flow outlet side, and that surrounds baffle plate 18 at a distance. While first housing part 7 is connected to jet fractionating device 2, in second housing part 8, at the flow outlet end thereof, only one honeycomb-shaped flow rectifier 14 is provided, which can be placed into housing part 8 from the flow inlet side up to a support situated on the edge.

Figure 15:
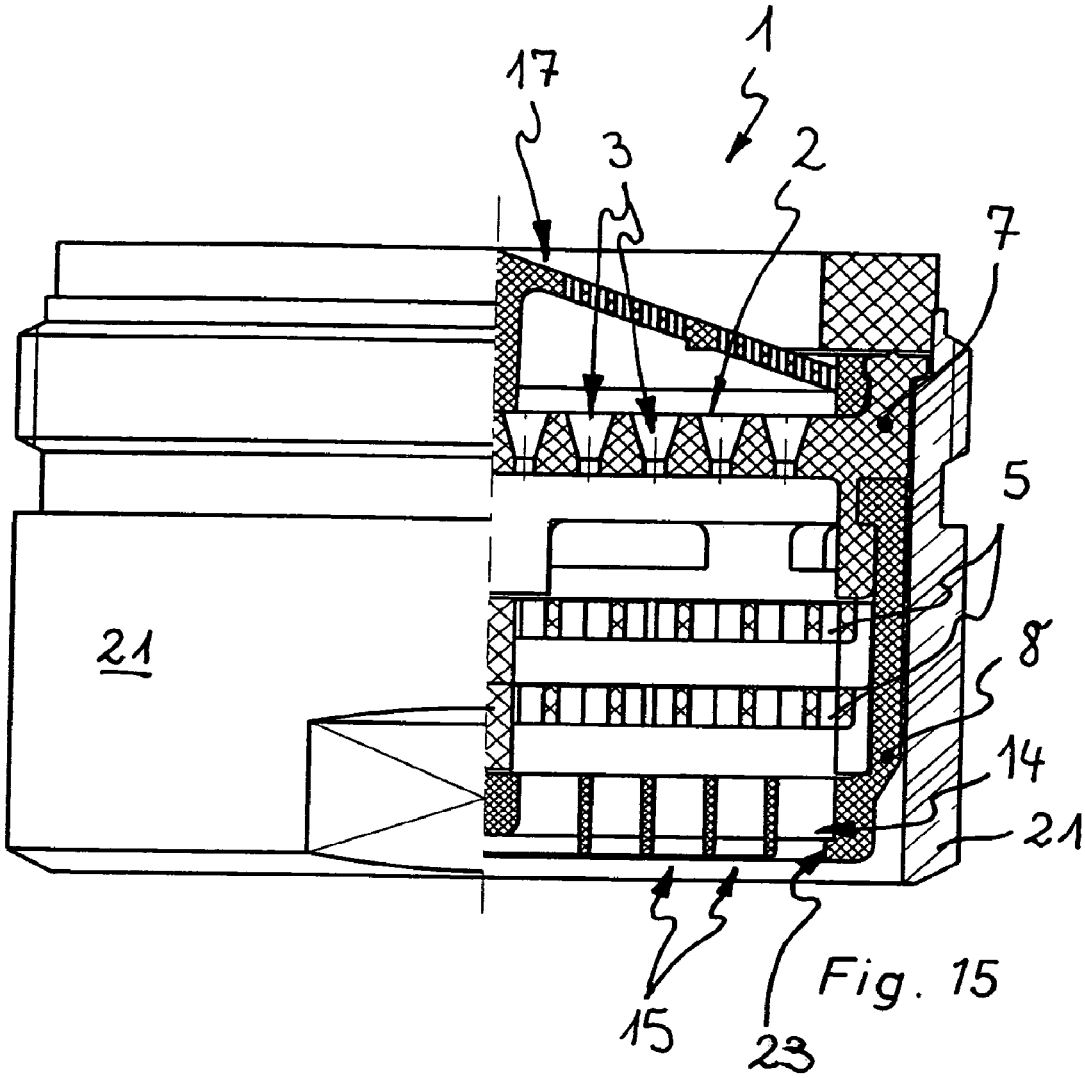
FIG. 15 shows, in partial longitudinal section, a jet regulator situated in an outflow mouth, whose lower sleeve-type housing part is made of an elastic material.

FIG. 15 shows a jet regulator 1 situated in an outflow mouth 21, whose sleeve-type external housing is made of the two housing parts 7, 8 that can be locked with one another in releasable fashion. Here, the housing part 7 at the flow inlet side is connected in one piece, and thus both fixedly and non-releasably, with perforated plate 2. While the flow inlet-side housing part 7 is made of a comparatively solid plastic material, the flow outlet-side housing part 8 is made of an elastic material, and has a soft, water-repellent surface. Because the housing part 8 thus also has a water-repellent surface in the area of its water exit opening, and thus in the area of flow rectifier 14 that is provided there, the jet regulator shown in FIG. 15 is distinguished by the freedom from calcification of flow outlet-side flow rectifier 14. Because the flow outlet-side housing part 8 is made of rubber, silicon, or a thermoplastic elastomer, and thus has an elastic, soft surface, calcifications or dirt particles that have deposited on the flow rectifier 14 can be easily removed manually. In order to further facilitate the manual cleaning of jet regulator 1, it can be advantageous if a partial area of jet regulator 1 at the outflow side extends at least slightly past outflow mouth 21.

As can be seen from FIG. 15, housing part 7 at the flow inlet side and outflow-side housing part 8 are held to one another in releasable fashion by a locking connection. This is shown in FIG. 1 where housing part 7 comprises a circumferential rib 30 and locks to housing part 8 via a mating circumferential groove. In order to prevent the possibility of withdrawing outflow-side housing part 8 axially from flow inlet-side housing part 7, the support shoulders on which both housing parts 7, 8 rest are formed such that they can accept sufficiently large forces. In addition, the outflow-side housing part 8 is stiffened by radial longitudinal webs 22 that are distributed uniformly in the circumferential direction in the area of the flow rectifier 14 and thus in the area of the exit opening. Longitudinal webs 22 provided on the rubber-like housing part 8, which lie very closely against the inner contour of the outflow mouth 21, prevent the rubber-like housing part 8 from expanding and thus from being withdrawn from the housing part 7. In any housing, the axial forces on the elastic housing part 8 arising due to water pressure are comparatively low, because the water pressure on the perforated plate that acts as the jet fractionating device 2 in the housing part 7 is already almost completely dismantled.

In FIG. 15, it can be seen that the outflow-side housing part 8 has a constriction 23 in the area of the water exit opening, effecting a narrowing of the flow cross-section. This narrowing of the flow cross-section achieves a calibration of the outflowing water jet and a homogenization of the jet pattern. The constriction 23 is provided in the area of the water exit opening, and thus in an area situated downstream, in the direction of flow, from possible disturbing contours. The calibration of the water jet significantly promotes a homogenous, non-spraying jet pattern.

Figure 16:
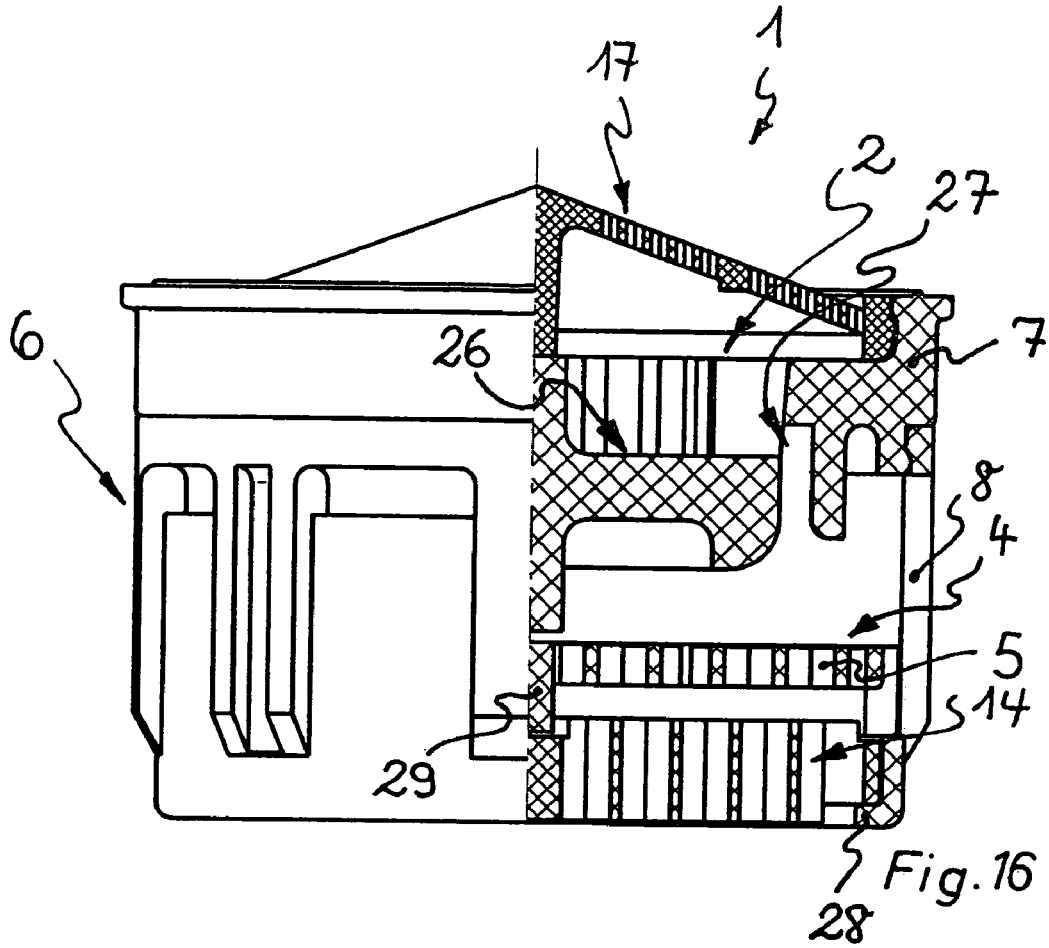
FIG. 16 shows a jet regulator similar to that shown in FIG. 1, whose jet fractionating device is here realized as a baffle plate.

FIG. 16 shows a jet regulator 1 comparable to that shown in FIG. 1. While the jet regulator shown in FIG. 1 has a perforated plate as the jet fractionating device 2, the jet fractionating device 2 of the jet regulator shown in FIG. 16 is formed as a baffle plate. The use of a jet fractionating device formed as a baffle plate is advantageous if the noise connected therewith can be disregarded in view of a particularly effective braking of the inflowing jet of liquid. From the partial longitudinal section in FIG. 16, it can be seen that the incoming jet of liquid impinges on a plate surface 26 situated transverse to the inflow direction, or the jet regulator longitudinal axis. The jet of liquid flows from this plate surface 26 in the radial direction to flow openings 27 that are provided on the peripheral wall surrounding plate surface 26. The jet of liquid, divided into individual jets in the flow openings 27, can subsequently flow to the jet regulating device 4 and/or to the flow rectifier 14, which are situated downstream in the direction of flow from the jet fractionating device 2.

The jet regulator shown in FIG. 16 likewise comprises a mounting housing 6 that is divided into two housing parts 7, 8 that can be connected with one another in releasable fashion. While the housing part 7 at the flow inlet side is connected fixedly and non-releasably with the jet fractionating device 2, which is formed as a baffle plate, two insert parts, both having honeycomb-shaped flow openings, are placed into the sleeve-shaped flow outlet-side housing part 8. While the flow inlet-side insert part 5, which is comparatively thin and is provided with small flow openings, acts as a jet regulating device, the flow outlet-side insert part, which is thicker and is provided with large flow openings, forms a flow rectifier that combines the individual jets to form a homogenous overall jet. The flow outlet-side insert part that forms the flow rectifier is adjacent to a radial peripheral edge 28 of the housing part 8, while the flow inlet-side insert part 5 is supported on the flow outlet-side insert part with a central spacing element 29.

The invention claimed is:

1. Jet regulator (1), having a flow inlet side and a flow outlet side and comprising a mounting housing (6), divided into first and second housing parts (7, 8), and the first and second housing parts (7, 8), which are releasably connectable via a snap-fit connection with one another, a jet fractionating device (2), having through flow holes (3), located inside the mounting housing (6), the first housing part (7), having a peripheral shoulder at the flow inlet side, is connected fixedly and non-detachably with the jet fractionating device (2), a jet regulating device (4), having at least one insert part (5) that is insertable into the mounting housing (6), and the at least one insert part (5) has webs (11) that are oriented transverse to a flow direction and that delimit between them through flow openings (12), the webs (11) of the at least one insert part (5) are disposed in the manner of a grid or a net, intersecting at intersect nodes (10), the jet regulating device (4) and a flow rectifier (14), having flow guide walls defining exit openings arranged in a plane, are arranged, downstream from the jet fractionating device (2), at the flow outlet side.

2. Jet regulator according to claim 1, wherein the first and second housing parts are connectable to one another in releasable fashion.

3. Jet regulator according to claim 1, wherein the jet fractionating device is formed as a perforated plate (2).

4. Jet regulator according to claim 1, wherein the jet regulator (1) comprises at least two of the jet regulating devices (4) that are receivable within the mounting housing (6), which is made of the first and second housing parts (7, 8), and the first and second housing parts are connectable to one another in releasable fashion.

5. Jet regulator according to claim 1, wherein the jet fractionating device (2) is connected in one piece with the first housing part (7).

6. Jet regulator according to claim 1, wherein the mounting housing (6) is comprised of the first and second housing parts (7, 8) adjacent to one another and are connectable to one another in a separating plane that is oriented transverse to a flow direction defined by the through flow openings (12, 15).

7. Jet regulator according to claim 1, wherein the housing parts (7, 8) of the mounting housing (6) can be locked together in releasable fashion.

8. Jet regulator according to claim 1, wherein the second housing part (8) is arranged at the flow outlet side of the jet regulator and is formed in a shape of a sleeve, and wherein the jet regulating device (4) comprises at least one insert part (5) receivable within the second housing part (8).

9. Jet regulator according to claim 8, wherein the at least one insert part (5) is insertable into the second housing part (8) from the flow inlet side, up to an insertion stop (9) or a support.

10. Jet regulator according to claim 1, wherein the jet regulating device (4) of the jet regulator (1) has a modular construction, and a plurality of insert parts (5*a*, 5*b*, 5*c*, 5*d*, 5*e*)that are combinable with one another.

11. Jet regulator according to claim 1, wherein the at least one insert part (5) of the jet regulating device (4) is situated relative to the jet fractionating device in such a way that individual jets produced by the jet fractionating device impinge on the intersect nodes (10) of the at least one insert part (5).

12. Jet regulator according to claim 1, wherein the jet regulating device (4) comprises at least two adjacent insert parts (5) having webs (11) that are disposed in the manner of a grid or net intersecting at intersect nodes (10).

13. Jet regulator according to claim 12, wherein the webs (11) and intersect nodes (10) of the at least two adjacent insert parts (5*a*, 5*b*) align with one another.

14. Jet regulator according to claim 13, wherein the at least two insert parts (5*a*, 5*b*)are of identical construction.

15. Jet regulator according to claim 13, wherein there are situated downstream, in the direction of flow, from through flow-openings (12) of one of the insert parts (5*a*, 5*c*), the intersect nodes (10) of the adjacent insert part (5*b*, 5*e*).

16. Jet regulator according to claim 1, wherein at least one insert part (5) arranged at the flow inlet side and/or one insert part (5) arranged at the flow outlet side is situated in a plane that is preferably oriented transverse to the direction of flow.

17. Jet regulator according to claim 1, wherein at least one insert part (5*a*, 5*b*) arranged at the flow inlet side and/or at the flow outlet side is formed in the manner of a grid, and has two intersecting sets of parallel grid webs.

18. Jet regulator according to claim 1, wherein the jet regulating device (4) comprises an insert part (5*c*) at the flow inlet side, and/or an insert part (5*c*) at the flow outlet side, the insert part (5*c*) having a set of radial webs (11') that intersect at intersect nodes with a set of concentric annular webs (11") in a single plane.

19. Jet regulator according to claim 1, wherein the jet regulating device comprises an insert part (5*d*) at the flow inlet side and/or the insert part (5*d*) at the flow outlet side the insert part (5*d*) having webs (11) that intersect in stelliform fashion or in the manner of a net in a single plane.

20. Jet regulator according to claim 1, wherein the at least one insert part (5) is plate-shaped.

21. Jet regulator according to claim 1, wherein there is connected downstream from the jet regulating device (4), at the flow outlet side, the flow rectifier (14) that comprises through flow openings (15) whose width is less than a length thereof in the direction of flow.

22. Jet regulator according to claim 21, wherein the flow rectifier (14) is situated at an exit end of the mounting housing (6).

23. Jet regulator according to claim 21, wherein the flow rectifier (14) is connected in one piece with the mounting housing (6), or can be placed into the mounting housing (6) as a separate insert part.

24. Jet regulator according to claim 21, wherein the flow rectifier (14) has through flow openings (15) that are rectangular, shaped as segments of a circle, or honeycomb-shaped.

25. Jet regulator according to claim 21, wherein the jet regulating device and/or the flow rectifier (14) include at least one metal sieve.

26. Jet regulator according to claim 1, wherein the second housing part (8) comprises a water exit opening at the flow outlet side and comprises, at least in an area of the water exit opening, a soft and/or water-repellent surface.

27. Jet regulator according to claim 26, wherein the second housing part (8) is manufactured, at least in the area of the water exit opening, from an elastic material.

28. Jet regulator according to claim 26, wherein the second housing part (8) at the outflow side is made of an elastic material and/or a material having a soft or water-repellent surface.

29. Jet regulator according to claim 26, wherein the second housing part (8) at the outflow side is stiffened by longitudinal webs (22) that are distributed, generally uniformly, in the circumferential direction.

30. Jet regulator according to claim 29, wherein the longitudinal webs (22) are provided at least in the area of the exit opening.

31. Jet regulator according to claim 1, wherein the second housing part (8) comprises a water exit opening at the flow outlet side and has, in an area of the water exit opening, at least one constriction (23) or similar narrowing of its flow cross-section.

32. Jet regulator according to claim 1, wherein the peripheral shoulder extends outwardly from the housing.

33. Jet regulator (1), having a flow inlet side and a flow outlet side and comprising a mounting housing (6), divided into first and second housing parts (7, 8), which are releasably connectable via a snap-fit connection with one another, a jet fractionating device (2), having through flow holes (3), located inside the mounting housing (6), the first housing part (7), having a peripheral shoulder at the flow inlet side, is connected fixedly and non-detachably with the jet fractionating device (2), a flow rectifier (14), having flow guide walls defining exit openings arranged in a plane, are arranged, downstream from the jet fractionating device (2), at the flow outlet side.

* * * * *